US007407036B2

(12) United States Patent
Kobayashi et al.

(10) Patent No.: US 7,407,036 B2
(45) Date of Patent: Aug. 5, 2008

(54) MUFFLER FOR COMPACT COMBUSTION ENGINES

(75) Inventors: Masanori Kobayashi, Kobe (JP); Tsuneyoshi Yuasa, Kobe (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 191 days.

(21) Appl. No.: 11/114,497

(22) Filed: Apr. 26, 2005

(65) Prior Publication Data

US 2005/0252715 A1 Nov. 17, 2005

(30) Foreign Application Priority Data

May 17, 2004 (JP) ..... 2004-146491

(51) Int. Cl.
*F01N 1/02* (2006.01)

(52) U.S. Cl. ..... 181/240; 181/258; 181/264; 181/265; 181/268; 181/269; 181/272; 60/299; 60/300; 60/301; 60/302

(58) Field of Classification Search ..... 181/240, 181/258, 264, 265, 268, 269, 272; 60/299, 60/300, 301, 302
See application file for complete search history.

(56) References Cited

U.S. PATENT DOCUMENTS 3,798,769 A * 3/1974 Bailey ..... 30/383
4,854,417 A * 8/1989 Uesugi et al. ..... 181/272
4,867,270 A * 9/1989 Wissmann et al. ..... 181/231
4,972,921 A * 11/1990 Takada et al. ..... 181/282
5,109,949 A * 5/1992 Sato et al. ..... 181/240
5,857,327 A * 1/1999 Sato et al. ..... 60/302
5,883,342 A * 3/1999 Wolpert ..... 181/230
6,044,926 A * 4/2000 Yamane et al. ..... 181/230
6,164,066 A * 12/2000 Sakaguchi et al. ..... 60/302
6,250,075 B1 * 6/2001 Funakoshi et al. ..... 60/299
6,393,835 B1 * 5/2002 Stoll et al. ..... 60/299
6,955,043 B2 * 10/2005 Schlossarczyk et al. ..... 60/299
7,174,991 B1 * 2/2007 Gunnarsson et al. ..... 181/231
2003/0085072 A1 * 5/2003 Mukaida ..... 181/272
2003/0173148 A1 * 9/2003 Andersson et al. ..... 181/272

FOREIGN PATENT DOCUMENTS

JP 2002-242666 8/2002
WO WO 0236942 A1 * 12/2002

* cited by examiner

*Primary Examiner*—Lincoln Donovan
*Assistant Examiner*—Jeremy Luks

(57) ABSTRACT

To provide a muffler for a compact combustion engine, which is simple in structure and effective to sufficiently reduce the temperature of exhaust gases while avoiding contact with an external air, an exhaust guide passage 7 for communicating the exhaust gases (G) to a discharge port (63) is provided within an interior hollow of a muffler housing 6 defining an exhaust chamber (61) therein, and a side wall of this exhaust guide passage (7) is constituted by a portion (6W) of the muffler housing (6) and a duct wall (71) jointed to the muffler housing (6).

11 Claims, 11 Drawing Sheets

MUFFLER FOR COMPACT COMBUSTION ENGINES

BACKGROUND OF THE INVENTION

1. Field of the Invention

The present invention relates to a muffler for a compact combustion engine used as a drive source in a portable work machine such as, for example, a brush cutting machine or a cleaning blower.

2. Description of the Prior Art

In this type of engine, it is generally desired to allow the combustion engine to discharge exhaust gases from an exhaust outlet to the outside after the temperature of the exhaust gases has been reduced.

On the other hand, in recent years even the compact combustion engines have come to use an oxidization catalyst for substantially purifying the exhaust gases, specifically reducing respective concentrations of HC and CO contained in the exhaust gases. The oxidization catalyst referred to above is incorporated in a muffler to allow unburned components of the exhaust gases to be reburned in contact with the catalyst. As is well known, reburning of the exhaust gases in contact with the catalyst results in increase of the temperature of the exhaust gas discharged from a discharge port. Accordingly, attempts have hitherto been made to use an auxiliary casing, formed separate from the muffler, on an exhaust side of the muffler so that the exhaust gases when flowing through the auxiliary casing can be cooled and then discharged to the outside. See, for example, the Japanese Laid-open Patent Publication No. 2002-242666, published Aug. 28, 2002.

It has, however, been found that the mere use of the auxiliary casing in association with the muffler incorporating a catalytic converter therein, such as disclosed in the above mentioned patent publication is incapable of providing a sufficient cooling effect since the temperature of the exhaust gases is extremely high. Also, while the wavelength of the pulsating motion of the exhaust gases tends to increase with decrease of the number of revolutions of the combustion engine and the velocity of flow of the exhaust gases is hence lowered, the distance from an outlet of the catalytic converter to the discharge port is short in the above mentioned patent publication, and as consequence, air tends to be sucked from the discharge port by the action of the pulsating motion of the exhaust gases to flow, in reverse to the outgoing exhaust gases, into a high temperature chamber after having passed through the catalytic converter, resulting in contact with high temperature unburned components of the exhaust gases that are left without being reburned in contact with the catalyst.

Where the separate auxiliary casing is fluidly connected with the exhaust side of the muffler by the use of connecting elements, such as disclosed in the above mentioned patent publication, the number of component parts used and the number of fitting steps tend to increase, resulting in increase of the cost.

SUMMARY OF THE INVENTION

In view of the foregoing, the present invention is intended to provide an improved muffler for a compact combustion engine, which is simple in structure and effective to sufficiently reduce the temperature of the exhaust gases while avoiding contact with an external air by the exhaust gases within the muffler.

In order to accomplish the foregoing object of the present invention, there is provided a muffler for a compact combustion engine for deadening exhaust gases emitted by the compact engine, which muffler includes a muffler housing defining an exhaust chamber therein, an exhaust guide passage provided within an interior hollow of the muffler housing and communicated with a discharge port, and a side wall defining the exhaust guide passage. This side wall is constituted by a portion of the muffler housing and a duct wall jointed to the muffler housing.

According to the present invention, the exhaust guide passage is formed by the duct wall and that portion of the muffler housing and an outer surface of the muffler housing is held in contact with the external atmosphere. Accordingly, heat evolved in the exhaust gases then flowing through the exhaust guide passage can be emitted to the outside through the muffler housing so that the exhaust gases can be sufficiently cooled. Also, since the exhaust guide passage can be designed to have a relatively large length and can also be designed to have a relatively small sectional area so as to allow the exhaust gases, flowing within the exhaust guide passage, to flow at an increased flow velocity, a reverse flow of the external air into the exhaust chamber through the exhaust guide passage by the effect of the pulsating motion of the exhaust gases can be effectively avoided, allowing the exhaust gases to be smoothly discharged to the outside. Moreover, since the exhaust guide passage is formed by the duct wall and that portion of the muffler housing as hereinbefore described, the structure can advantageously be simplified and the production cost can also be reduced.

In a preferred embodiment of the present invention, the muffler may further include a catalytic converter disposed within the interior hollow of the muffler housing for substantially purifying the exhaust gases and a partition wall disposed within the interior hollow of the muffler housing and dividing the exhaust chamber into upstream and downstream compartments with respect to the catalytic converter, in which case at least a portion of the duct wall is positioned within the upstream compartment.

According to this feature, since the exhaust gases of a relatively low temperature, or unburned components thereof, which have not yet been reburned within the catalytic converter, drift within the upstream compartment having at least that portion of the duct wall positioned therein, the exhaust gases of a relatively high temperature flowing through the exhaust guide passage after the catalytic converter can be heat-radiated into the upstream compartment through that portion of the duct wall within the upstream compartment and can therefore be cooled. Accordingly, even the exhaust gases of the high temperature having moved past the catalytic converted can be cooled sufficiently.

In another preferred embodiment of the present invention, the muffler may further include an exhaust cap defining the discharge port, the exhaust cap being formed integrally with an outer side wall of the muffler housing. According to this feature, the exhaust gases can be discharged from the discharge port to the outside after the direction of flow of the exhaust gases has been controlled by the exhaust cap to a predetermined direction, a direct blow of the high temperature exhaust gases towards a muffler covering or the like can advantageously be suppressed. Also, since the exhaust cap is formed integrally with the muffler housing by the utilization of a portion of the muffler housing, the number of component parts used can advantageously be reduced, resulting in reduction of the cost.

In a further preferred embodiment of the present invention, a spark arrester may be retained between the exhaust cap and the duct wall. According to this feature, since the spark arrester is retained by the utilization of the exhaust cap and the duct wall without the use of any fastening elements such as, for example, screws, the number of component parts used can advantageously be reduced, resulting in reduction of the cost.

In a still further preferred embodiment of the present invention, a diffusion piece may be employed in the muffler for diffusing the exhaust gases emerging outwardly from the exhaust cap. According to this feature, by the diffusion effect exhibited by the diffusion piece on the exhaust gases, the temperature of the exhaust gases discharged to the outside can be reduced advantageously.

In a still further preferred embodiment of the present invention, the exhaust guide passage may extend in a vertical direction and has an inlet opening positioned in a lower region of the exhaust chamber. According to this feature, positioning of the discharge port at an upper region of the muffler housing is effective to increase the length of the exhaust guide passage so that the effect of cooling the exhaust gases flowing therethrough can be increased. The exhaust guide passage may have a length, which is greater than one half a vertical length of the muffler housing.

In a still further preferred embodiment of the present invention, the exhaust chamber may be divided by a horizontally extending partition wall into an upper upstream compartment and a lower downstream compartment, a catalytic converter supported by the horizontally extending partition wall for substantially purifying the exhaust gases, and the inlet opening of the exhaust guide passage may be positioned within the downstream compartment Preferably, the exhaust guide passage may have a cross-sectional area that is smaller at a downstream portion thereof than at an upstream portion thereof. According to this feature, the exhaust gases can be smoothly discharged to the outside by allowing the exhaust gases, then flowing through the exhaust guide passage, to flow at an increased flow velocity while a drawing of an external air into the exhaust guide passage is prevented.

In a still further preferred embodiment of the present invention, the exhaust chamber may be divided by a vertically extending partition wall into an inner upstream compartment and an outer downstream compartment. In this case, a catalytic converter may be supported by the vertically extending partition wall for substantially purifying the exhaust gases.

Alternatively, the exhaust chamber may be divided by a vertically extending partition wall into an inner upstream compartment and an outer downstream compartment, in which case the exhaust guide passage is positioned within the downstream compartment and represents a generally U-shaped configuration having an inlet opening arranged at an upper region of the downstream compartment. According to this feature, the exhaust guide passage has a length so increased that the effect of cooling the exhaust gases flowing therethrough can be increased.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Hereinafter, preferred embodiments of a muffler for a compact internal combustion engine according to the present invention will be described in detail with reference to the accompanying drawings.

Figure 1:
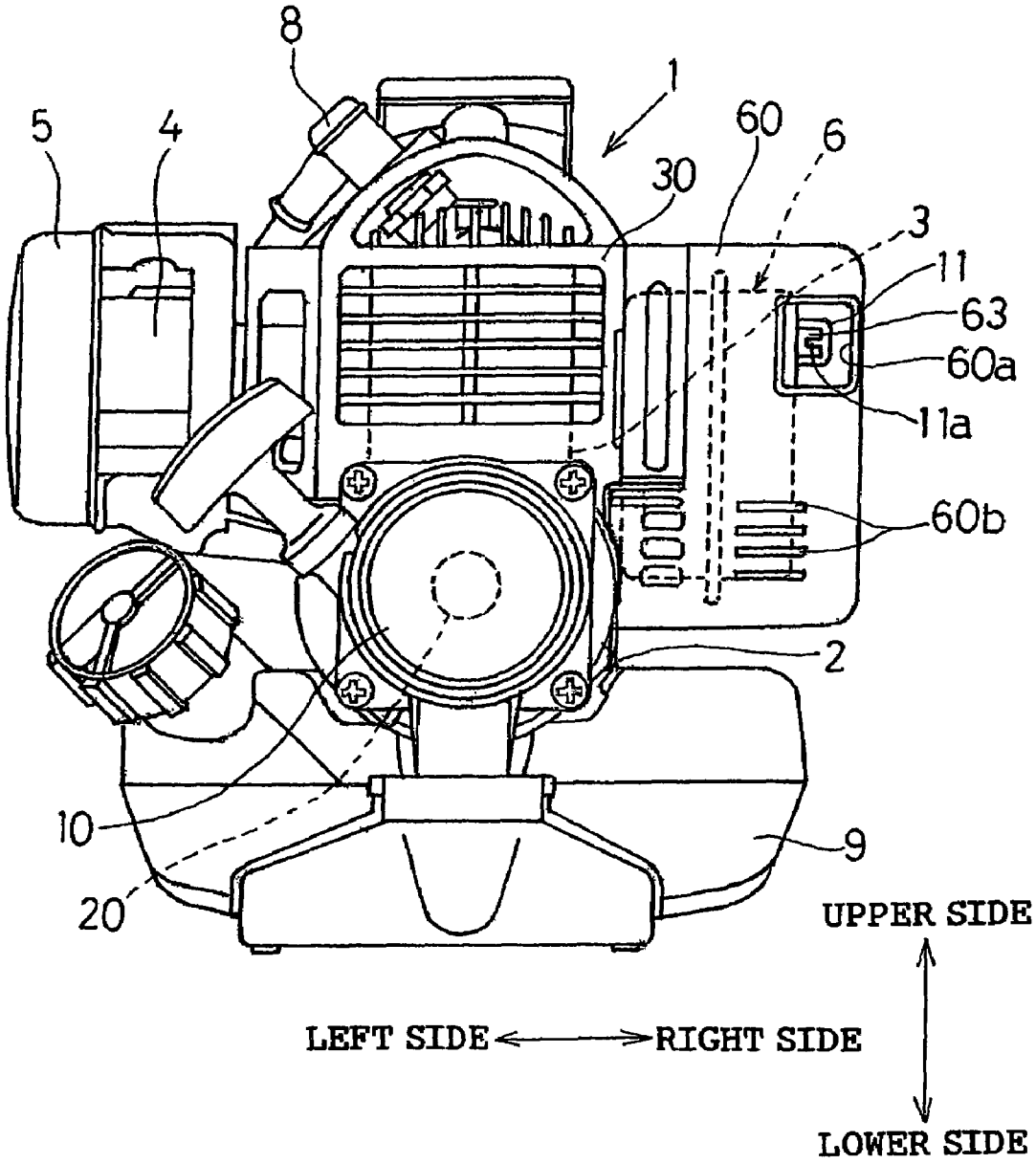
FIG. 1 is a rear end view of a compact internal combustion engine equipped with a muffler designed in accordance with a first preferred embodiment of the present invention.

Referring particularly to FIG. 1, there is shown a rear end view of the compact internal combustion engine equipped with the muffler 6 designed in accordance with a first preferred embodiment of the present invention. As shown therein, the combustion engine, identified generally by 1, includes a crankcase 2, a cylinder block 3 mounted on the crankcase 2, and a crankshaft 20 rotatably supported within the crankcase 2 so as to extend in a direction longitudinally of the combustion engine 1, i.e., in a direction perpendicular to the sheet of FIG. 1. A carburetor 4 and an air cleaner assembly 5 fluidly connected with the carburetor 4 are arranged on a left side, as viewed in FIG. 1, of the cylinder block 3 and the muffler 6 designed in accordance with the present invention is arranged on a right side of the cylinder block 3.

An ignition plug 8 is mounted atop the cylinder block 3 and a fuel tank 9 is secured to the crankcase 2 and positioned therebelow. The cylinder block 3 is covered by a shroud 30 made of a synthetic resin and, similarly, the muffler 6 is covered by a muffler covering 60 made of a synthetic resin. A recoil starter 10 is fitted to a rear surface of the crankcase 2.

Figure 2:
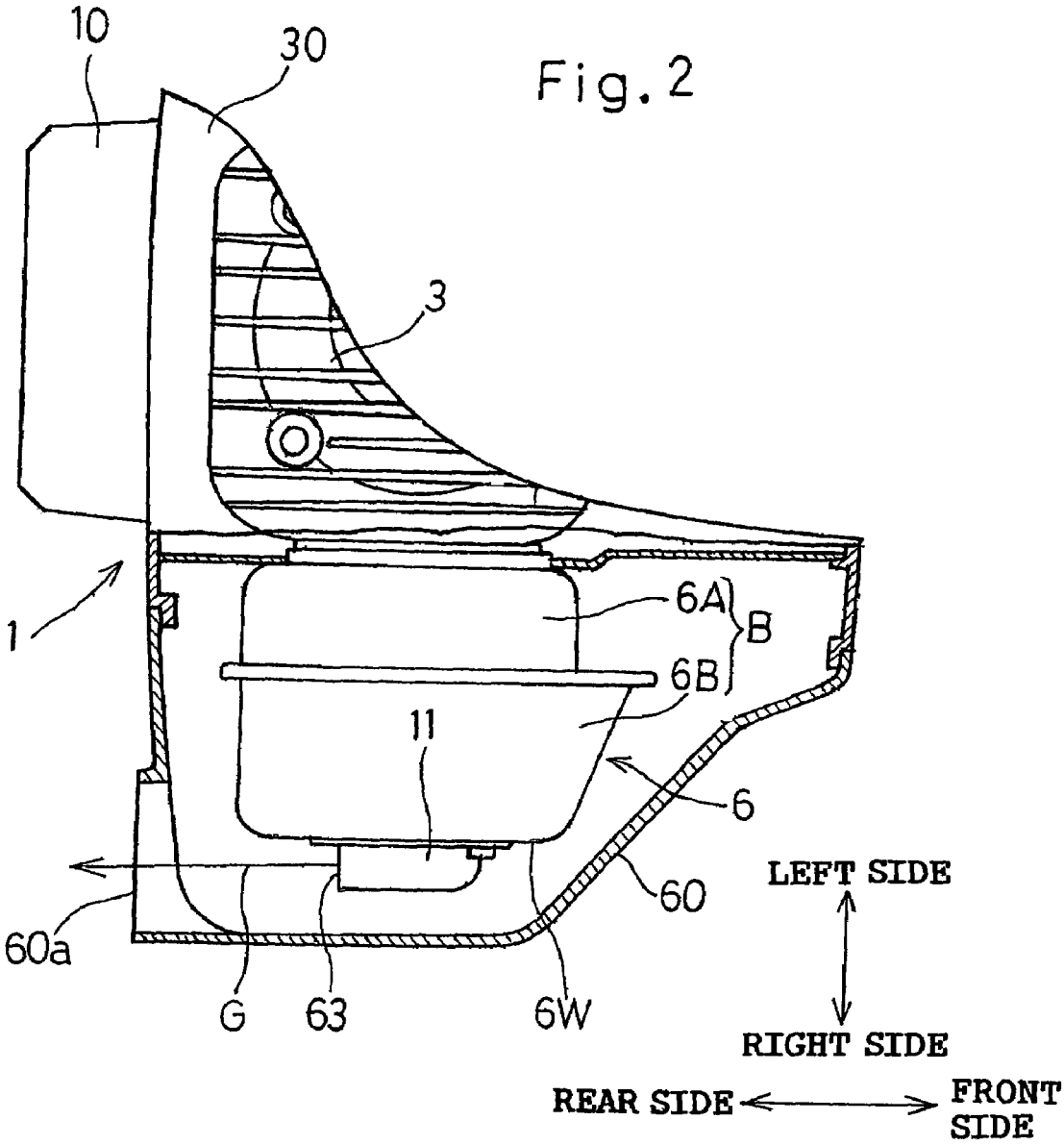
FIG. 2 is a fragmentary top plan view, showing a portion of the combustion engine cut away to show the muffler.

FIG. 2 illustrates, in a fragmentary top plan view, a portion of the combustion engine 1 cut away to show the muffler 6. As shown therein, the muffler 6 includes a muffler housing B of a generally rectangular box-like configuration made up of first and second halves 6A and 6B prepared from a metallic plate such as, for example, a stainless metallic plate and being of a generally cup-like configuration. Those housing halves 6A and 6B are combined together to define the housing B having an interior hollow which defines an exhaust chamber as indicated by 61 in FIG. 4. A portion of the muffler covering 60 enclosing the muffler, which is rearwardly of the combustion engine 1, is formed with an exhaust outlet 60*a* from which exhaust gases G can be exhausted to the outside of the muffler 6. The muffler covering 60 has its substantially entire surface area formed with a plurality of heat releasing slits 60*b* as shown in FIG. 1 for releasing heat to the outside of the muffler covering 60.

Figure 3:
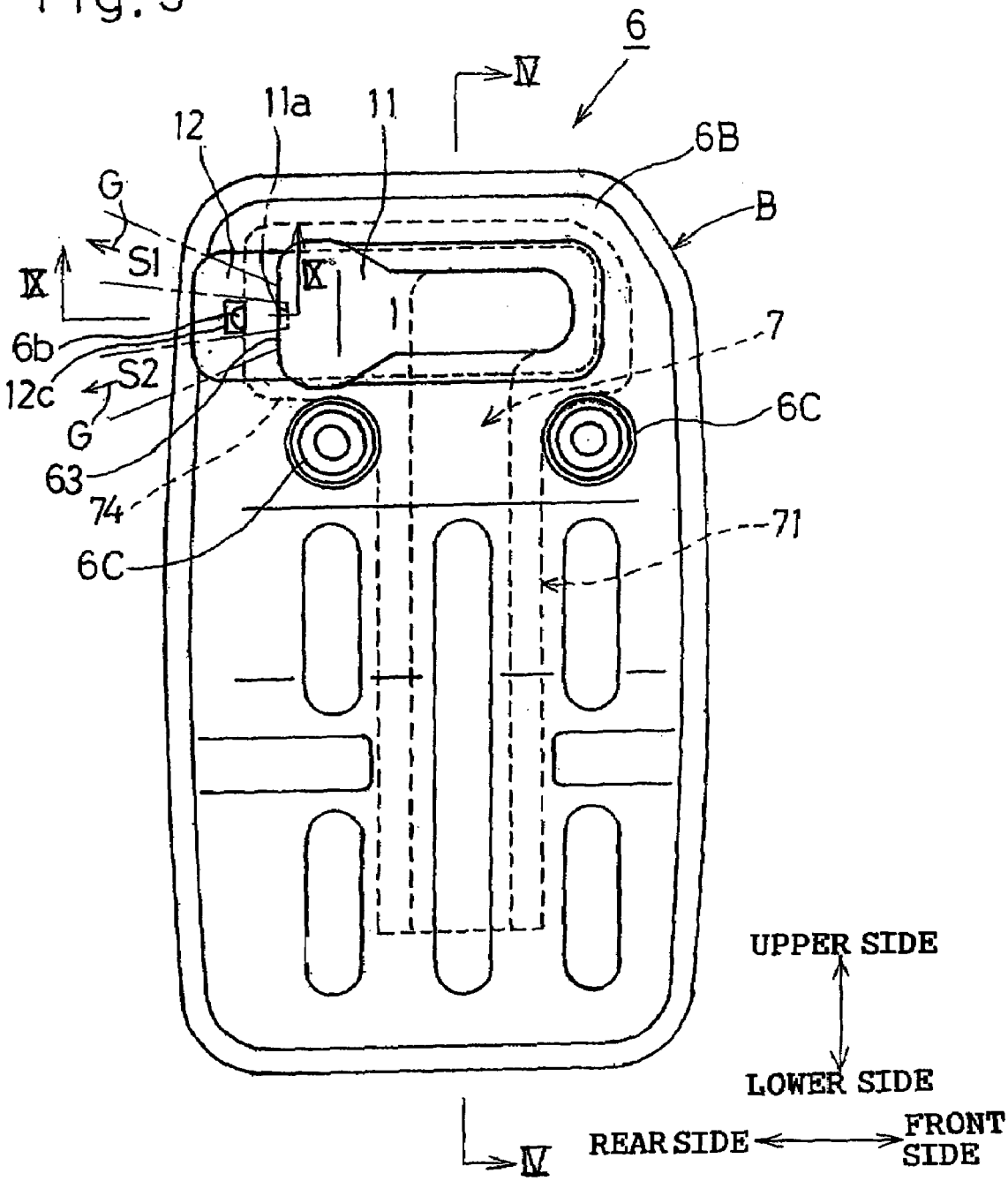
FIG. 3 is a right side view of the muffler shown on an enlarged scale.
Figure 4:
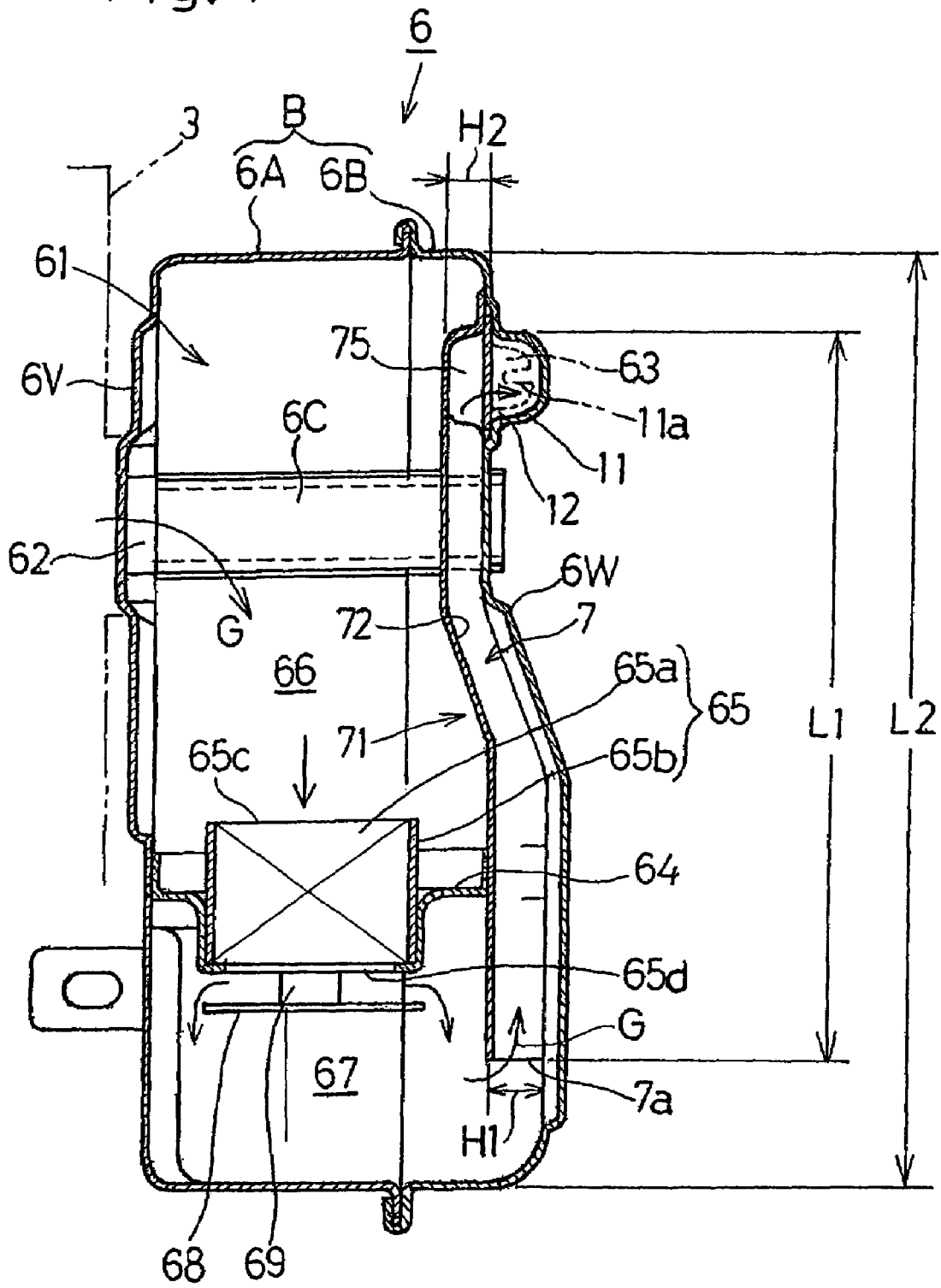
FIG. 4 is a cross-sectional view taken along the line IV-IV in FIG. 3.

Referring particularly to FIG. 3, showing a right hand side view of the muffler 6, and also to FIG. 4 showing a cross-sectional view of the muffler 6 taken along the line IV-IV in FIG. 3, a left side wall 6V of the first housing half 6A best shown in FIG. 4, which is an inner side wall of the first housing half 6A adjacent the cylinder block 3, is formed with an introducing port 62 through which exhaust gases G from a combustion chamber within the cylinder block 3 can be introduced into the exhaust chamber 61 of the muffler housing B. On the other hand, as best shown in FIG. 3, a right side wall 6W of the second housing half 6B remote from the cylinder block 3, which is an outer side wall of the second housing half 6B, has a right upper portion formed with a discharge port 63 opening rearwardly of the combustion engine 1, as shown by the double-dotted chain line, for discharging the exhaust gas G. The exhaust chamber 61 of the muffler housing B has a partition wall 64 extending transversely or horizontally as viewed in FIG. 4, and a catalytic converter 65 is fixedly mounted on the partition wall 64 in an upright position, i.e., with its longitudinal axis oriented vertically as viewed in FIG. 4. The partition wall 64 and the catalytic converter 65 thereon divide the exhaust chamber 61 into an upper or upstream compartment 66 and a lower or downstream chamber 67 positioned below the upstream compartment 66.

The catalytic converter 65 includes a carrier 65*b* such as, for example, a honeycomb core carrying oxidization catalyst 65*a* such as, for example, platinum for substantially purifying the exhaust gases G and has an intake opening 65*c* held in communication with the upstream compartment 66 and a discharge opening 65*d* held in communication with the downstream compartment 67 so that, as shown by the arrows in FIG. 4, the exhaust gases G introduced into the upstream compartment 66 through the introducing port 62 can flow into the downstream compartment 67 after having been oxidized in contact with the oxidization catalyst 65*a* within the catalytic converter 65. As best shown in FIG. 4, the muffler housing B is provided with a pair of transversely extending tubes 6C positioned in an upper region thereof or of the upstream compartment 66, in parallel relation with each other for the passage therethrough of respective bolts that are used to connect the muffler 6 with the cylinder block 3.

As best shown in FIG. 4, a baffle plate 68 is disposed within the downstream compartment 67 and positioned adjacent to and in face-to-face relation with the discharge opening 65*d* of the catalytic converter 65. This baffle plate 68 is utilized to allow the exhaust gases G, emerging outwardly from the catalytic converter 65 through the discharge port 65*d*, to collide against the baffle plate 68 so that the exhaust gases G can be diffused within the downstream compartment 67. The use of the baffle plate 68 is effective to increase a sound deadening or silencing effect. This baffle plate 68 is supported by the catalytic converter 65 by means of one or more support legs 69.

Referring still to FIG. 4, an exhaust guide passage 7 is defined within a portion of the body B, specifically within the second housing half 6B. This exhaust guide passage 7 extends substantially vertically within the exhaust chamber 61 and along the outer side wall 6W of the second housing half 6B in a vertical direction from a generally intermediate region of the downstream compartment 67 to an upper region of the upstream compartment 66 and an upper end held in communication with the discharge port 63. This exhaust guide passage 7 is delimited by a portion of the outer side wall 6W of the second housing half 6B and a substantially vertically extending duct wall 71 welded to the outer side wall 6W of the second housing half 6B.

It is, however, to be noted that in order to provide the exhaust gases G, then flowing through the exhaust guide passage 7, with a sufficient cooling effect, the inlet opening 7*a* of the exhaust guide passage 7 is located in a lower region of the exhaust chamber 61 or in a region of the downstream compartment 67 generally intermediate of the height thereof so that the exhaust guide passage 7 can have an increased length L1. Assuming that the muffler housing B has a length L2 as measured in a vertical direction, the length L1 of the exhaust guide passage 7 as discussed above is preferably greater than half the vertical length L2 of the muffler housing B, i.e., L1>(½)L2.

Figure 5A:
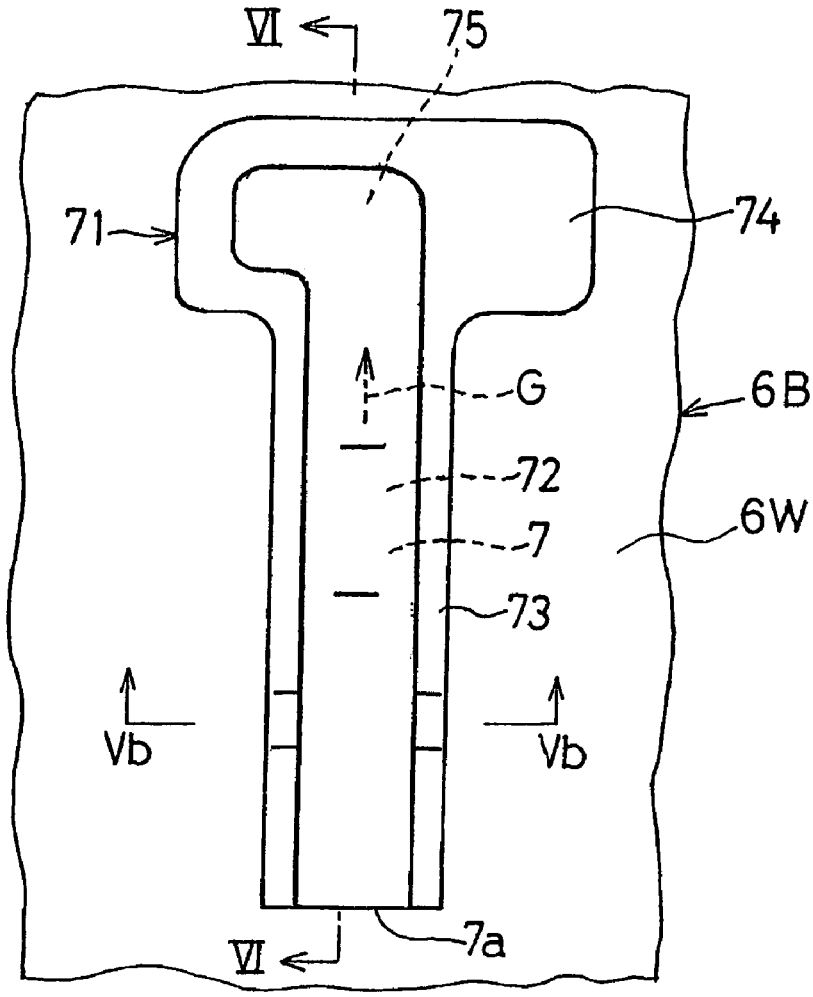
FIG. 5*a* is a fragmentary side view showing, on an enlarged scale, a duct wall of the muffler as viewed from a left side in FIG. 4.
Figure 5B:
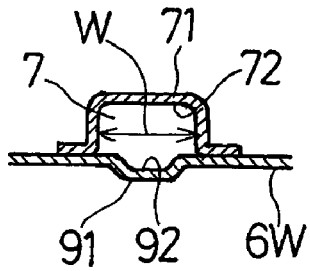
FIG. 5*b* is a crossed-sectional view taken along the line Vb-Vb in FIG. 5*a*.
Figure 6:
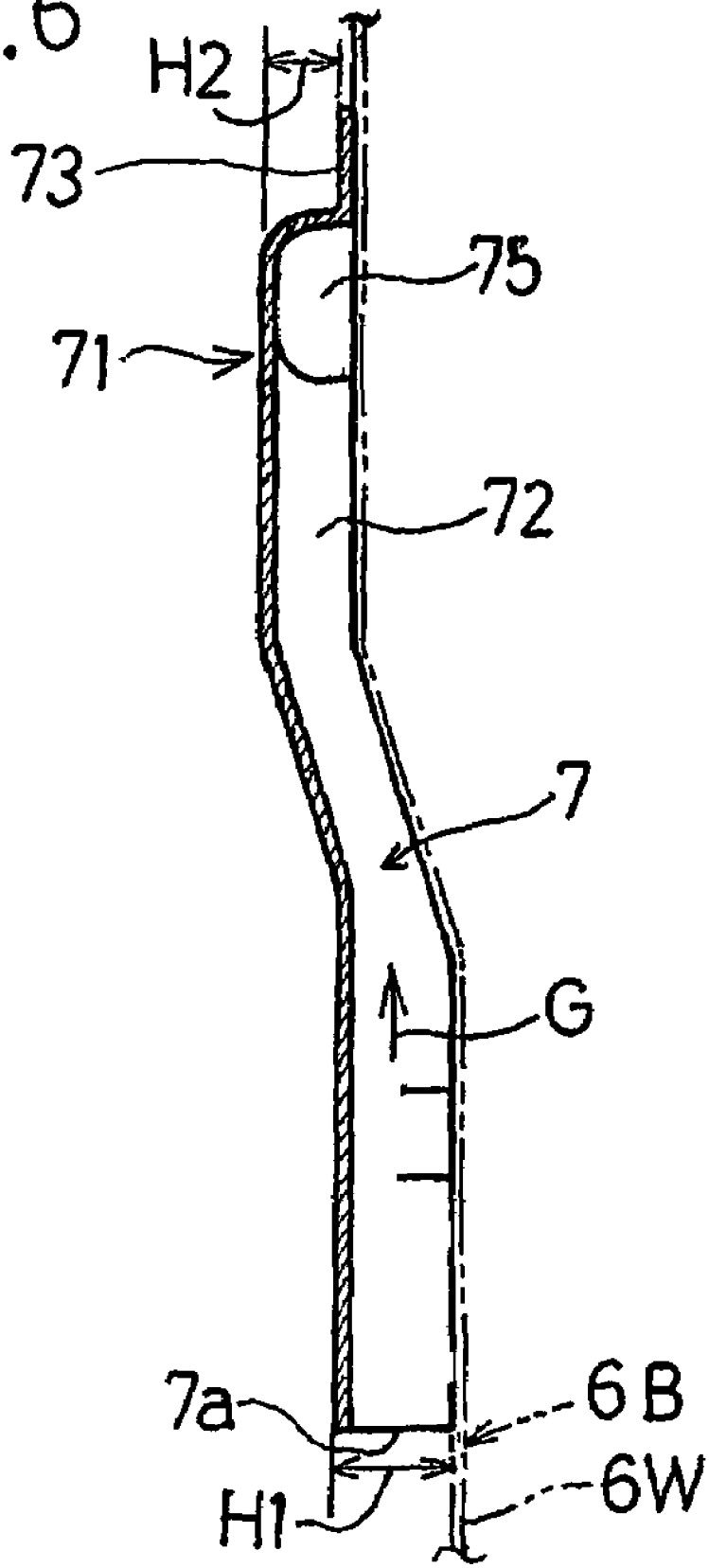
FIG. 6 is a cross-sectional view, on an enlarged scale, taken along the line VI-VI in FIG. 5.

FIG. 5*a* illustrates a fragmentary side view showing, on an enlarged scale, the duct wall 71 as viewed from a left side in FIG. 4 and FIG. 5*b* illustrates the cross-section of the duct wall 71, taken along the line Vb-Vb in FIG. 5*a*. FIG. 6 illustrates the cross-section on an enlarged scale taken along the line VI-VI in FIG. 5*a*. The duct wall 71 shown in FIG. 5*a* is prepared from a metallic plate such as, for example, a stainless metallic plate and is shaped by the use of any known press work to have a recess 72 extending substantially vertically. The vertically extending recess 72 itself defines the exhaust guide passage 7 delimited between the duct wall 71 and the outer side wall 6W of the second housing half 6B, when the duct wall 71 is fixed to the outer side wall 6W. In order to allow the duct wall 71 to be welded to the outer side wall 6W, the duct wall 71 is formed with a collar piece 73 protruding laterally outwardly from a substantially entire outer peripheral edge thereof. Thus, as shown in FIG. 5*b*, the duct wall 71 so configured represents a shape generally similar to the shape of a figure "Ω", with laterally outwardly protruding bases of this figure defining the collar piece 73 for connection with the outer side wall 6W of the second housing half 6B. The outer side wall 6W is formed with a reinforcement rib 91 protruding outwardly and extending vertically from a lower portion to an intermediate portion thereof. The rib 91 confronts to the duct wall 71 and provides a narrow channel 92 forming a portion of the exhaust guide passage 7.

The duct wall 71 has its upper portion formed with a tongue 74 continued from a portion of the collar piece 73 so as to extend in a direction rearwardly of the combustion engine 1 and to confront with an exhaust cap 11 as will be described in detail later with particular reference to FIG. 3, whereas a large width recess extension 75 is formed continued from an upper region of the recess 72, which is on a downstream side with respect to the direction of flow of the exhaust gases G through the exhaust guide passage 7.

The width of the recess 72, that is, the width W of the exhaust guide passage 7 is chosen to be at a substantially constant value along the direction of flow of the exhaust gases G (i.e., in the vertical direction). However, in order to increase the velocity of flow of the exhaust gases G within the exhaust guide passage 7 so that the exhaust gases G can be smoothly exhausted to the outside while preventing the external air from being drawn into the exhaust guide passage 7, a height or distance over which the upstream end of the exhaust guide passage 7 rises away from the outer side wall 6W is set to have values H1 and H2 at respective upstream and downstream ends with the latter H2 is smaller than the former Hi. In other words, the exhaust guide passage 7 has a cross-sectional area that is smaller at a downstream portion of the exhaust guide passage 7 than at an upstream portion thereof.

Figure 7:
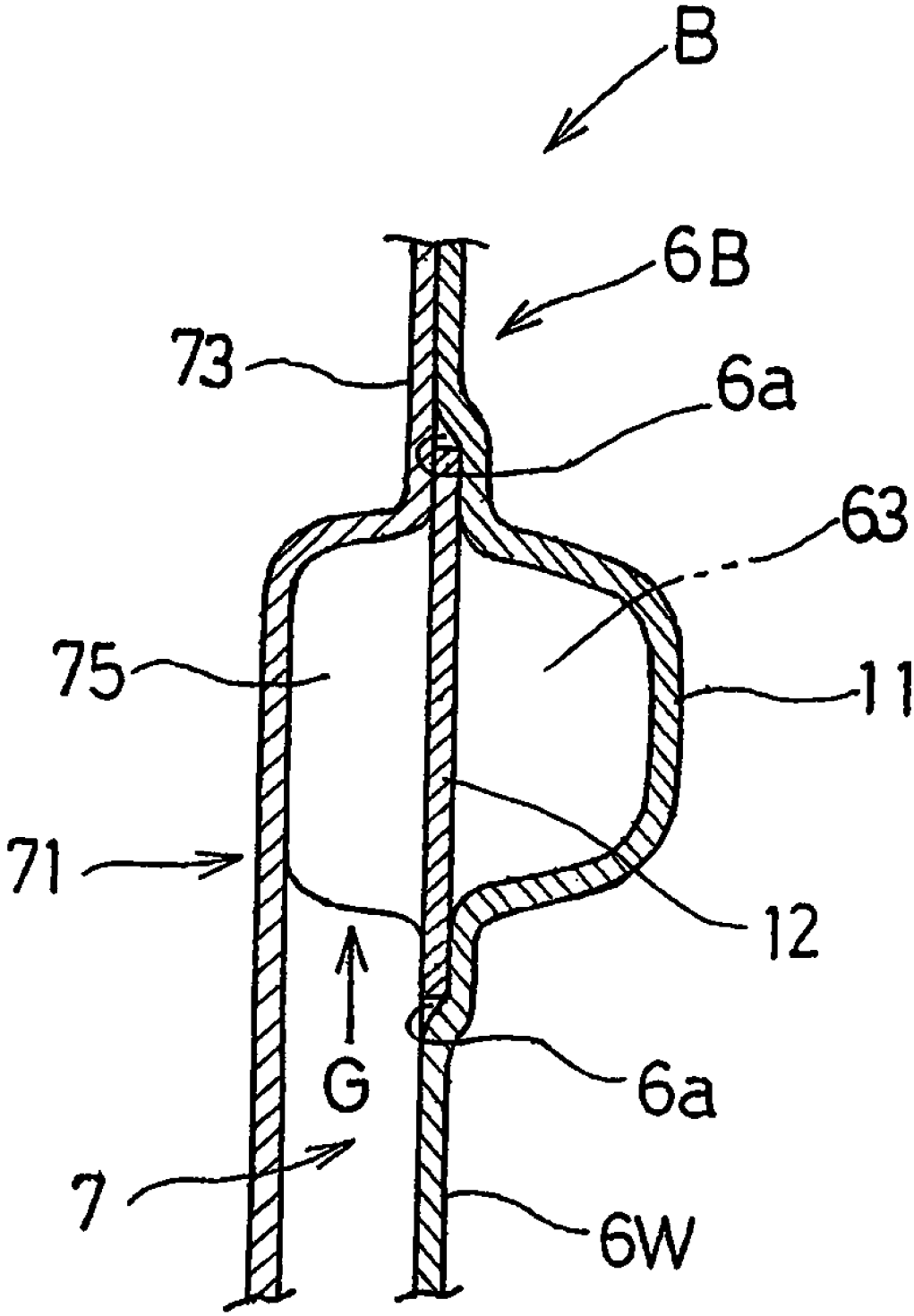
FIG. 7 is a fragmentary sectional view showing, on an enlarged scale, an upper portion of an exhaust guide passage shown in FIG. 4.

FIG. 7 is a fragmentary sectional view showing, on an enlarged scale, that upper portion of the exhaust guide passage shown in FIG. 4. As shown therein, a portion of the outer side wall 6W of the second housing half 6B, which is aligned with the large width recess extension 75 of the duct wall 71, is formed integrally with the exhaust cap 11 referred to previously by means of a drawing technique so as to protrude outwardly. This exhaust cap 11 is operable to allow the exhaust gases G to flow along an outer surface of the outer side wall 6W towards the outside. This exhaust cap 11 is formed with the discharge port 63, referred to previously, at an open end thereof, as shown in FIG. 3, so that the exhaust gases G can be discharged to the outside through this discharge port 63. As shown in FIG. 7, a portion of the outer side wall 6W, which is aligned with the duct wall 71 and upper and lower regions of the exhaust cap 11, is formed with a recess depressed outwardly (i.e., rightwardly as viewed in FIG. 7) to define, in cooperation with the duct wall 71, a slit 6*a* for retaining a spark arrester 12.

Figure 8:
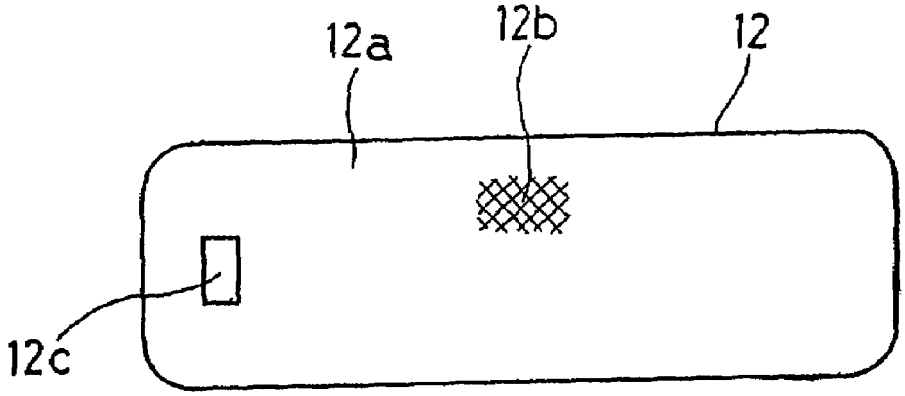
FIG. 8 is a front elevational view of a spark arrester.

FIG. 8 illustrates a front elevational view of the spark arrester 12. As shown therein, the spark arrester 12 includes a generally rectangular frame 12*a* in the form of an elongated plate member and a screen 12*b* having a plurality of meshes and jointed or welded to the frame 12*a*. The rectangular frame 12*a* has one end portion formed with an engagement hole 12*c* for engagement of the spark arrester 12.

Figure 9:
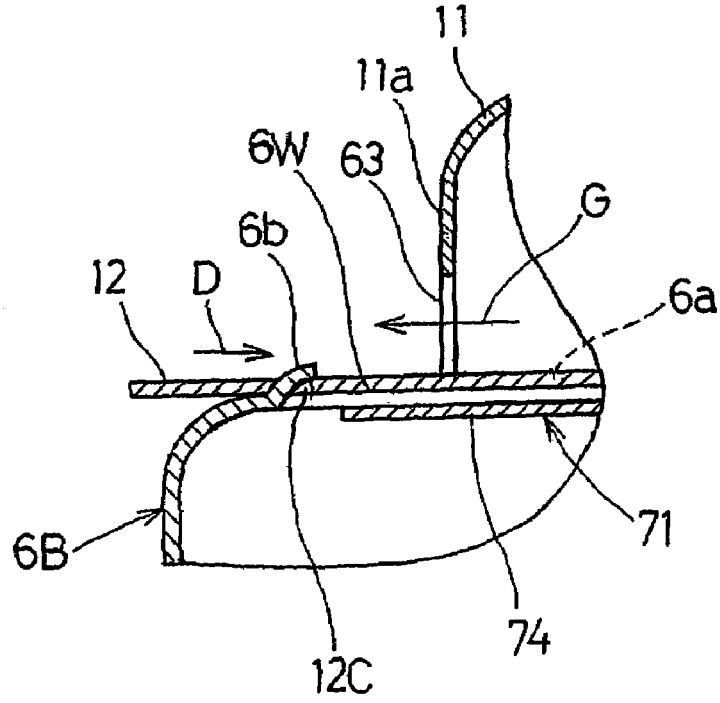
FIG. 9 is a fragmentary cross-sectional view on an enlarged scale, taken along the line IX-IX in FIG. 3.

FIG. 9 is a fragmentary cross-sectional view on an enlarged scale, taken along the line IX-IX in FIG. 3, showing the details of a structure necessary to retain the spark arrester 12. As shown therein, the outer side wall 6W of the second housing half 6B is formed with a projection 6*b*, engageable in the engagement hole 12*c* in the rectangular frame 12*a*, by means of a lancing technique so as to protrude outwardly. When the spark arrester 12 is pushed in a direction, shown by the arrow D, so that the spark arrester 12 can be inserted into the slit 6*a* (FIG. 7), the spark arrester 12 can be retained intervening between the tongue 74 of the duct wall 71 and the exhaust cap 11, with the projection 6*b* engaged in the engagement hole 12*c*. Also, the exhaust cap 11 has a diffusion piece 11*a* formed integrally at the open end so as to protrude towards the outer side wall 6W of the second housing half 6B. This diffusion piece 11*a* is operable to diffuse the exhaust gases G towards the neighborhood of the discharge port 63 with respect to the direction of opening of the discharge port 63 and is, as best shown in FIG. 4, positioned at a location substantially intermediate of the opening of the discharge port 63 with respect to the vertical direction.

The operation of the muffler 6 designed in accordance with the foregoing embodiment of the present invention will now be described. The exhaust gases G emitted from the cylinder block 3 shown in FIG. 4 is introduced into the upstream compartment 66 through the introducing port 62 of the muffler 6 and is hence expanded within the upstream compartment 66 with the noises deadened consequently. The exhaust gases G within the upstream compartment 66 then flows through the catalytic converter 65 and as they flow through the catalytic converter 65, unburned components of the exhaust gases G are removed in contact with the catalyst 65*a* with the concentrations of HC and CO in the exhaust gases G reduced consequently. The substantially purified exhaust gases G emerging outwardly from the catalytic converter 65 collide against the baffle plate 68 and then flow into the downstream compartment 67 where they are again expanded with the noises deadened.

The exhaust gases G within the downstream compartment 67 subsequently flow into the exhaust guide passage 7 through the inlet opening 7*a* of the exhaust guide passage 7 and is then guided towards the discharge port 63 in the exhaust cap 11. Considering that the exhaust guide passage 7 is formed by the duct wall 71 and that portion of the outer side wall 6W of the second housing half 6B, which is held in contact with the external atmosphere, heat evolved in the exhaust gases G can be emitted to the atmosphere through the outer side wall 6W with the exhaust gases G cooled consequently. Also, since the length L1 of the exhaust guide passage 7 is so chosen as to satisfy the relationship of L1>(½)L2 relative to the length L2 of the muffler housing B as hereinbefore described, the exhaust guide passage 7 has a substantially increased length enough to allow the exhaust gases G to be cooled sufficiently. Yet, because of the increased length of the exhaust guide passage 7, an undesirable drawing of an external air from the discharge port 63 into the downstream compartment 67 of the exhaust chamber 61 through the exhaust guide passage 7 can be avoided effectively.

In addition, designing the vertically extending recess 72 of the duct wall 71, which defines the exhaust guide passage 7, so that the distance H2 of rise at the downstream end of the exhaust guide passage 7 is smaller than the distance H1 of rise at the upstream end of the exhaust guide passage 7 is effective to allow the exhaust guide passage 7 to have the downstream end thereof throttled relative to the upstream end thereof. Accordingly, the exhaust gases G flowing out of the exhaust guide passage 7 can have an increased velocity and, therefore, even though the exhaust gases G happen to flow in a pulsating fashion, a reverse flow of the external air through the exhaust guide passage 7, which would occur as a result of the drawing of the external air from the discharge port 63, can be effectively avoided, allowing the exhaust gases G to be smoothly discharged to the outside. Moreover, since the exhaust guide passage 7 is formed by the duct wall 71 and that portion of the second housing half 6B as hereinbefore described, the structure can advantageously be simplified and the production cost can also be reduced.

Considering that the duct wall 71 extends to an upper region of the upstream compartment 66 and that exhaust gases G of a relatively low temperature prior to being substantially purified by the catalytic converter 65 drift within such upstream compartment 66, the exhaust gases G of a relatively high temperature having passed through the catalytic converter 65 and then flowing through the exhaust guide passage 7 can be cooled in contact with the duct wall 71. Accordingly, even the high temperature exhaust gases G having passed through the catalytic converter 65 can be sufficiently cooled.

Also, the exhaust gases G flowing through the exhaust guide passage 7 is introduced from the large width recess extension 75, formed in an upper region of the duct wall 71 in continuance with the recess 73, into the exhaust cap 11 through the spark arrester 12 and is then deflected by the exhaust cap 11 so as to flow towards the discharge port 63. The exhaust gases G are then, as shown in FIG. 2, discharged from the discharge port 63 so as to flow along the outer side wall 6W of the second housing half 6B and be subsequently discharged to the outside of the combustion engine 1 through the exhaust outlet 60*a* of the muffler covering 60. Accordingly, an undesirable direct contact of the high temperature exhaust gases G with the muffler covering 60 made of the synthetic resin can advantageously be avoided. Also, since the exhaust cap 11 is formed integrally with that portion of the outer side wall 6W of the second housing half 6B as shown in FIG. 7, the number of component parts used and the production cost can be reduced advantageously.

The spark arrester 12 is retained in position with the engagement hole 12*c* receiving therein the projection 6*b* integral with the outer side wall 6W of the second housing half 6B. This is accomplished, as shown in FIG. 9, by inserting the spark arrester 12 into the slit 6*a* formed at the junction between the outer side wall 6W of the second housing half 6B and the duct wall 71 until the projection 6*b* formed in the outer side wall 6W is engaged in the engagement hole 12*c* formed in the spark arrester 12. Accordingly, with no need to use any fastening elements such as screws, the spark arrester 12 can be retained in position and the number of component parts used and the cost of manufacture can advantageously be reduced.

In addition, since the diffusion piece 11*a* is formed in the open end of the exhaust cap 11 as shown in FIG. 1, the diffusion piece 11*a* allows the exhaust gases G to be diffused mainly upwardly and downwardly with respect to the direction of opening of the discharge port 63 as shown in FIG. 3, and are then discharged from the discharge port 63 so as to flow in two regions shown by the double-dotted lines S1 and S2. For this reason, by the effect of the diffusion piece 11*a* diffusing the exhaust gases G in the manner described above, the temperature of the exhaust gases G discharged to the outside of the combustion engine 1 from the exhaust outlet 60*a* of the muffler covering 60 shown in FIG. 2 can be lowered.

Figure 10:
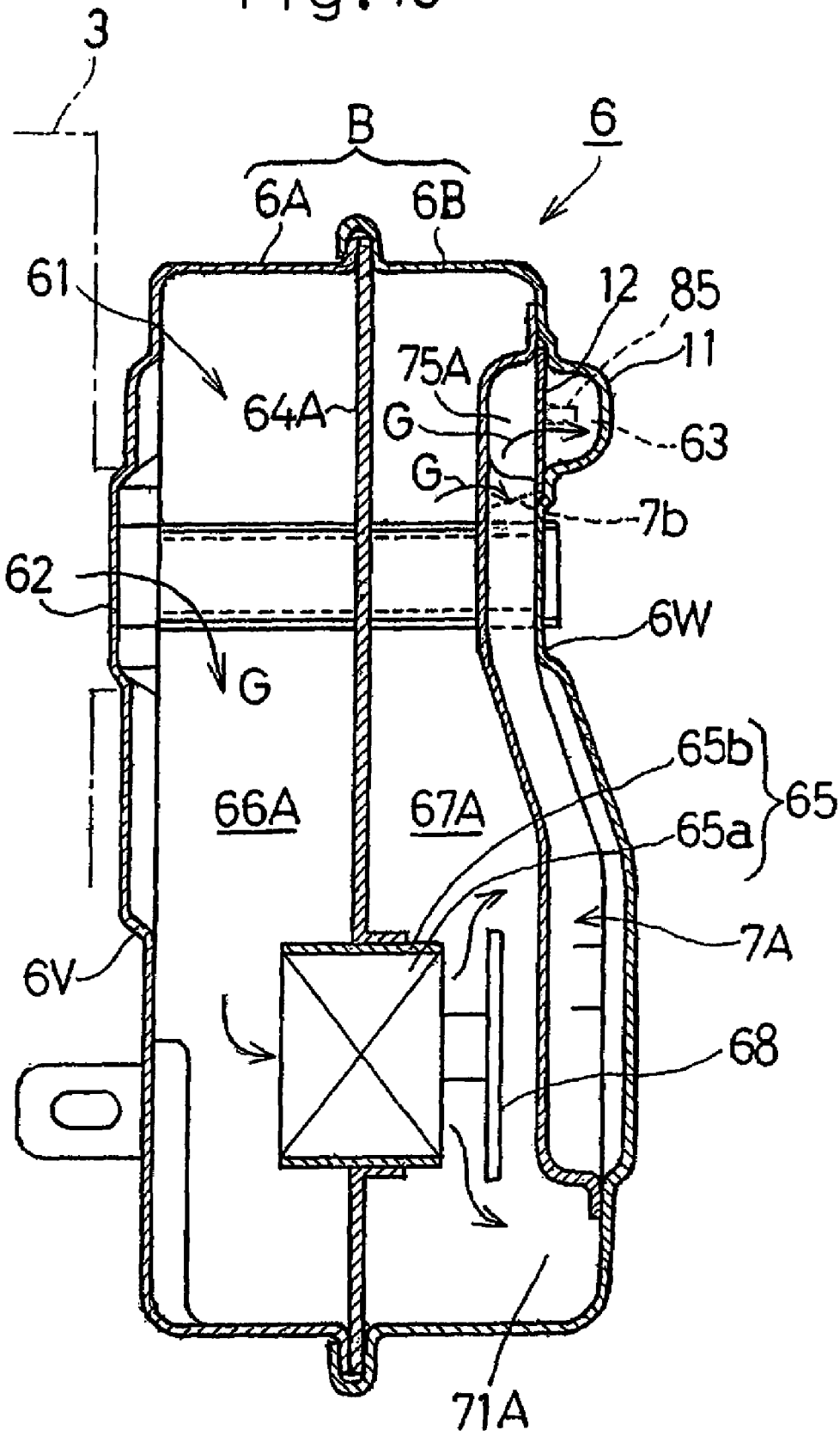
FIG. 10 is a longitudinal sectional view of the muffler according to a second preferred embodiment of the present invention.

FIG. 10 illustrates, in a longitudinal sectional representation, the muffler according to a second preferred embodiment of the present invention. The muffler 6 shown in FIG. 10 is different from the muffler 6 shown and described in connection with the foregoing embodiment, in that the exhaust chamber 61 of the muffler housing B has a partition wall 64A extending vertically as viewed in FIG. 10 or in a direction substantially parallel to the longitudinal axis of the cylinder block 3, and a catalytic converter 65 is fixedly mounted on the partition wall 64 in a horizontally laid position with its longitudinal axis oriented horizontally. The partition wall 64A and the catalytic converter 65 thereon divide the exhaust chamber 61 into a left or upstream compartment 66A adjacent the cylinder block 3 and a right or downstream compartment 67A remote from the cylinder block 3, with the intake and discharge openings of the catalytic converter 65 held in communication with the upstream and downstream compartments 66A and 67A, respectively.

Even in the second embodiment of the present invention, the second housing half 6B is provided with an exhaust guide passage 7A constituted by a portion of the outer side wall 6W of the second housing half 6B and a duct wall 71A welded to the outer side wall 6W of the second housing half 6B as is the case with the foregoing embodiment described with particular reference to FIG. 4. In particular, since the duct wall 71A is arranged in the downstream compartment 67A, that is, a high temperature region of the exhaust gases G having passed through the catalytic converter 65, the exhaust guide passage 7A employed in the practice of this second embodiment is so designed and so tailored as to have an increased length, as compared with that of the exhaust guide passage 7 employed in the previously described embodiment, in order for the exhaust gases G, then flowing through the exhaust guide passage 7A defined within the duct wall 71A, to be sufficiently cooled.

Figure 11:
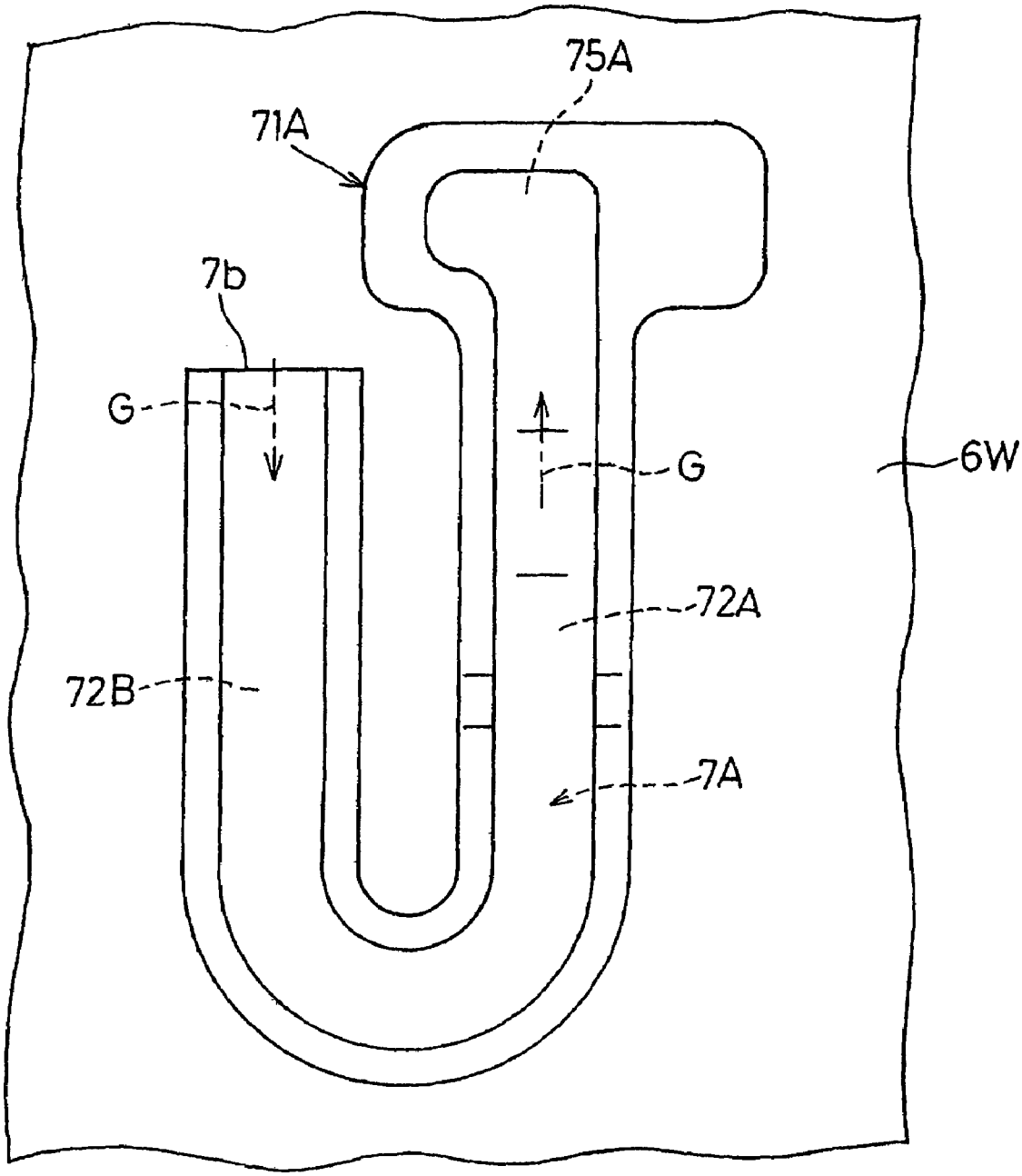
FIG. 11 is a fragmentary side view on an enlarged scale, showing the duct wall in the muffler shown in FIG. 10.

FIG. 11 is a fragmentary side view on an enlarged scale, showing the duct wall 71A as viewed from a left side in FIG. 10. The duct wall 71A has a recess 72A defined therein, which represents a generally U-shaped configuration including a passage extension 72B continued from a lower end of the exhaust guide passage 7A and turned upwardly from such lower end of the exhaust guide passage 7A so as to extend to a position adjacent a large width recess extension 75A. An inlet opening 7*b* leading to the exhaust guide passage 72A is defined in an upper end of the passage extension 72B for the introduction of the exhaust gases G from the downstream compartment 67A (FIG. 10) into the passage extension 72B.

Figure 12:
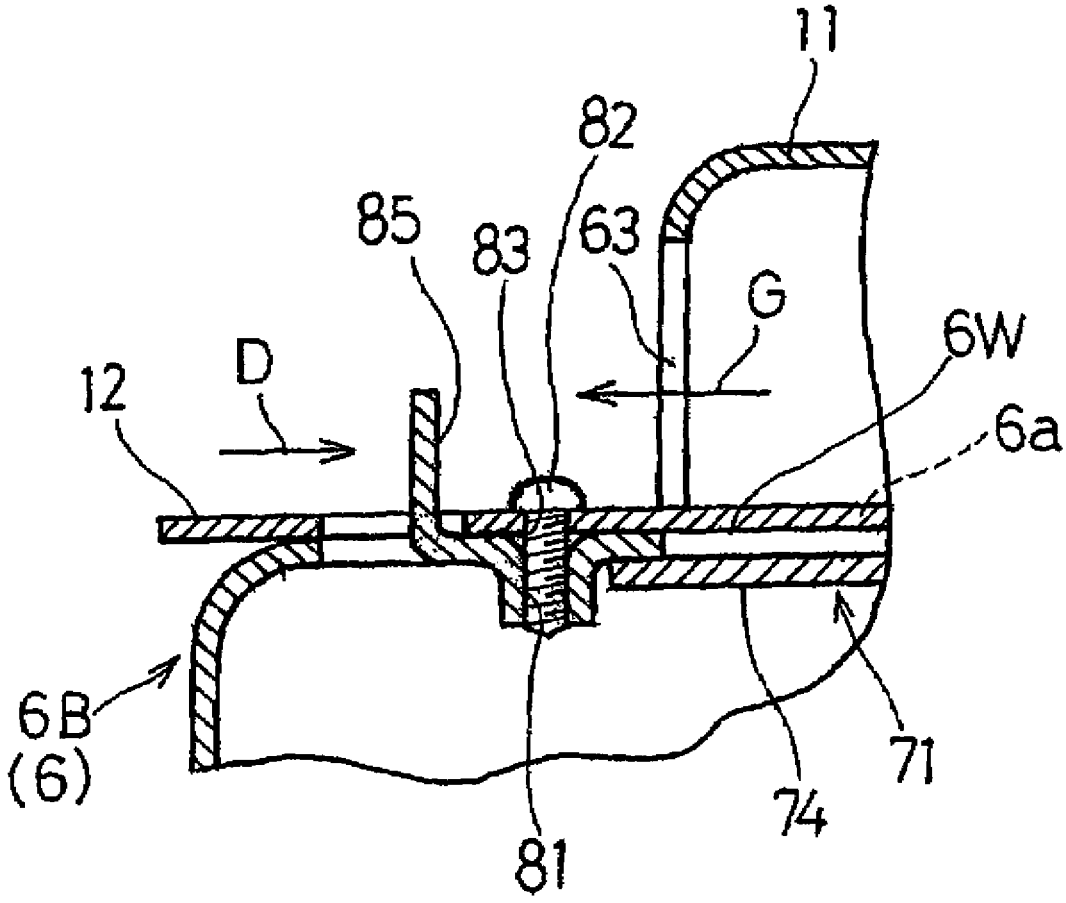
FIG. 12 is a view similar to FIG. 9, showing a portion of the muffler in the vicinity of a discharge port according to the second preferred embodiment of the present invention.

FIG. 12 illustrates an enlarged sectional view similar to FIG. 3 and showing a portion of the muffler in the vicinity of the discharge port 63. As shown therein, the outer side wall 6W of the second housing half 6B of the muffler 6 is formed with a burring 81 for the engagement of the spark arrester 12. After the spark arrester 12 has been pushed in a direction shown by the arrow D to allow the spark arrester 12 to be inserted into the slit 6*a* (FIG. 7), a tapping screw 82 is inserted into an insertion hole 83, formed in the spark arrester 12 and is then threaded into the burring 81 to thereby fix the spark arrester 12 to the muffler 6. After the spark arrester 12 has been so fixed to the muffler 6, a portion of the outer side wall 6W of the second housing half 6B is lanced to extend in a direction substantially perpendicular to the outer side wall 6W and then externally through the spark arrester 12, thereby forming a diffusion piece 85 for diffusing the exhaust gases G hen flowing outwardly from the discharge port 63. This diffusion piece 85 is positioned at a location forwardly of the discharge port 63 in the exhaust cap 11 and, as shown in FIG. 10, generally intermediate of the direction upwardly and downwardly of the discharge port 63.

While the muffler according to the second embodiment of the present invention is so constructed as hereinabove described, the exhaust gases G emitted from the combustion chamber within the cylinder block 3 flows, after having been introduced into the upstream compartment 66A of the muffler 6 as shown by the arrow in FIG. 10, into the catalytic converter 65, and the substantially purified exhaust gases G emerging outwardly from the catalytic converter 65 is, after having been collided against the baffle plate 68, introduced nto the downstream compartment 67A. The exhaust gases G within the downstream compartment 67A flows into the exhaust guide passage 7A within the duct wall 71A through the inlet opening 7*b* formed in the upper end of the passage extension 72B of the duct wall 71A as shown in FIG. 11.

The exhaust gases G so introduced into the exhaust guide passage 7A is, after having traveled along a generally U-shaped path through the exhaust guide passage 7A, discharged to the outside from the recess extension 75A by way of the interior of the exhaust cap 11 shown in FIG. 10 and then the discharge port 63. Considering that in this second embodiment the exhaust guide passage 7A is formed by adding the passage extension 72B to the duct wall 71A, a substantially long exhaust gas passage can be secured and the area of a heat radiating surface defined by the outer side wall 6W of the second housing half 6B is increased. Accordingly, even though the exhaust guide passage 7A is arranged in the downstream compartment 67A on a downstream side of the catalytic converter 65, that is, a high temperature region of the exhaust gases G having passed through the catalytic converter 65, the exhaust gases G can be efficiently and sufficiently cooled.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. A muffler for a compact combustion engine for deadening exhaust gases emitted by the compact engine, which muffler comprises:

a muffler housing defining an exhaust chamber therein;

an exhaust guide passage provided within an interior hollow of the muffler housing and communicated with a discharge port; and a side wall defining the exhaust guide passage, the side wall being constituted by a portion of the muffler housing and a duct wall jointed to the muffler housing, and wherein the exhaust chamber is divided by a horizontally extending partition wall into an upper upstream compartment and a lower downstream compartment with a catalytic converter supported by the horizontally extending partition wall for substantially purifying the exhaust gases, and an inlet opening of the exhaust guide passage is positioned within the downstream compartment, wherein a downstream portion of the duct wall is positioned within the upstream compartment, and wherein the discharge port is positioned in an upper region of the upstream compartment.

2. The muffler for the compact combustion engine as claimed in claim 1, further comprising an exhaust cap defining the discharge port, the exhaust cap being formed integrally with an outer side wall of the muffler housing.

3. The muffler for the compact combustion engine as claimed in claim 2, further comprising a spark arrester retained between the exhaust cap and the duct wall.

4. The muffler for the compact combustion engine as claimed in claim 1, further comprising an exhaust cap defining the discharge port and a diffusion piece for diffusing the exhaust gases emerging outwardly from the exhaust cap.

5. The muffler for the compact combustion engine as claimed in claim 1, wherein the exhaust guide passage has a length, which is greater than one half a vertical length of the muffler housing.

6. The muffler for the compact combustion engine as claimed in claim 1, wherein the exhaust guide passage has a cross-sectional area that is smaller at a downstream portion thereof than at an upstream portion thereof.

7. A muffler assembly for a compact combustion engine comprising:

a muffler housing having a first housing half member and a second housing half member collectively defining an exhaust chamber therein;

an exhaust guide passage provided within an interior hollow of the muffler housing and communicated with a discharge port;

a side wall defining the exhaust guide passage, the side wall being constituted by a portion of the second housing half member and a duct wall jointed to the second housing half member housing;

a catalytic converter disposed within the interior hollow of the muffler housing for substantially purifying the exhaust gases and a partition wall disposed within the interior hollow for dividing the exhaust chamber into upstream and downstream compartments with respect to the catalytic converter and wherein at least a portion of the duct wall is positioned within the upstream compartment; and a muffler covering member enclosing the muffler housing, and wherein the exhaust chamber is divided by a horizontally extending partition wall into an upper upstream compartment and a lower downstream compartment with a catalytic converter supported by the horizontally extending partition wall for substantially purifying the exhaust gases, and an inlet opening of the exhaust guide passage is positioned within the downstream compartment, wherein a downstream portion of the duct wall is positioned within the upstream compartment, and wherein the discharge port is positioned in an upper region of the upstream compartment.

8. The muffler assembly for the compact combustion engine as claimed in claim 7, further comprising an exhaust cap defining the discharge port, the exhaust cap being formed integrally with an outer side wall of the muffler housing, and extending across an exterior surface of the second housing half member.

9. The muffler assembly for the combustion engine as claimed in claim 8, wherein the muffler covering member is molded from a resin material.

10. The muffler assembly for the compact combustion engine as claimed in claim 7, wherein the exhaust guide passage has a length, which is greater than one half a vertical length of the muffler housing.

11. The muffler assembly for the compact combustion engine as claimed in claim 7, wherein the exhaust guide passage has a cross-sectional area that is smaller at a downstream portion thereof than at an upstream portion thereof.

* * * * *